US010651570B2

(12) United States Patent
Lukyanov et al.

(10) Patent No.: US 10,651,570 B2
(45) Date of Patent: May 12, 2020

(54) ELECTRONIC DEVICE HAVING ANTENNA UNIT

(71) Applicant: Samsung Electronics Co., Ltd., Suwon-si, Gyeonggi-do (KR)

(72) Inventors: Anton Sergeevich Lukyanov, Moscow (RU); Elena Aleksandrovna Shepeleva, Kostroma (RU); Gennadiy Aleksandrovich Evtyushkin, Moscow (RU); Alexander Nikolaevich Khripkov, Moscow (RU); Artem Yurievich Nikishov, Moscow (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 113 days.

(21) Appl. No.: 15/857,398

(22) Filed: Dec. 28, 2017

(65) Prior Publication Data

US 2018/0191081 A1 Jul. 5, 2018

(30) Foreign Application Priority Data

Dec. 29, 2016 (RU) ..... 2016152509
Oct. 17, 2017 (KR) ..... 10-2017-0134786

(51) Int. Cl.
*H01Q 21/06* (2006.01)
*H01Q 13/26* (2006.01)
(Continued)

(52) U.S. Cl.
CPC ..... *H01Q 21/068* (2013.01); *H01P 3/16* (2013.01); *H01P 5/087* (2013.01); *H01P 5/107* (2013.01);
(Continued)

(58) Field of Classification Search
CPC ..... H01Q 21/06; H01Q 1/24; H01Q 1/42; H01Q 13/26; H01Q 19/06; H01Q 19/10
(Continued)

(56) References Cited

U.S. PATENT DOCUMENTS 3,225,351 A 12/1965 Chatelain et al.
7,595,765 B1 9/2009 Hirsch et al.
(Continued)

FOREIGN PATENT DOCUMENTS

JP 2005-217864 A 8/2005
JP 2005217864 * 11/2005 ..... H01Q 13/22
WO 2004079861 A1 9/2004

OTHER PUBLICATIONS

ISA/KR, "International Search Report and Written Opinion of the International Searching Authority," International Application No. PCT/KR2017/015643, dated Apr. 6, 2018, 10 pages.
(Continued)

*Primary Examiner* — Andrea Lindgren Baltzell

(57) ABSTRACT

An antenna unit includes a dielectric substrate; a dielectric cover on the dielectric substrate; and an antenna array. The antenna array includes antenna elements arranged in the dielectric substrate and configured to form traveling waves propagating in the dielectric substrate and the dielectric cover. The antenna unit also includes at least one spatial matching element arranged in space formed inside the dielectric substrate, spatially matched with the dielectric cover, and coupled with the at least one antenna element. The spatial matching element is configured to be spatially matched with the antenna array with the dielectric cover and to reduce reflections of traveling waves propagating from the antenna array to the dielectric cover. The antenna device may be diversified.

15 Claims, 6 Drawing Sheets

(51) Int. Cl.

| | |
|---|---|
| ***H01P 3/16*** | (2006.01) |
| ***H01P 5/08*** | (2006.01) |
| ***H01Q 1/24*** | (2006.01) |
| ***H01Q 1/42*** | (2006.01) |
| ***H01P 5/107*** | (2006.01) |
| ***H01Q 19/10*** | (2006.01) |
| ***H01Q 19/06*** | (2006.01) |
| *H01Q 1/28* | (2006.01) |
| *G04G 21/04* | (2013.01) |
| *H01Q 1/44* | (2006.01) |

(52) U.S. Cl.
CPC ..... *H01Q 1/243* (2013.01); *H01Q 1/42* (2013.01); *H01Q 13/26* (2013.01); *H01Q 19/06* (2013.01); *H01Q 19/106* (2013.01); *H01Q 21/065* (2013.01); *G04G 21/04* (2013.01); *H01Q 1/28* (2013.01); *H01Q 1/44* (2013.01)

(58) Field of Classification Search
USPC ..... 343/731
See application file for complete search history.

(56) References Cited

U.S. PATENT DOCUMENTS

| | | | | |
|---|---|---|---|---|
| 8,760,352 | B2 | 6/2014 | Rao et al. | |
| 2016/0028148 | A1 | 1/2016 | Tan et al. | |
| 2016/0104944 | A1 | 4/2016 | Rajagopalan et al. | |
| 2016/0134021 | A1* | 5/2016 | Helander ..... | H01Q 9/0407 343/893 |

OTHER PUBLICATIONS

European Patent Office, "Supplementary European Search Report," Application No. EP17887822.9, dated Aug. 26, 2019, 10 pages.
Hong, Wonbin, "Grid Assembly-Free 60 GHz Antenna Module Embedded in FR-4 Transceiver Carrier Board," IEEE Transactions on Antennas and Propagation, 2011, 10 pages.

* cited by examiner

ELECTRONIC DEVICE HAVING ANTENNA UNIT

CROSS-REFERENCE TO RELATED APPLICATIONS AND CLAIM OF PRIORITY

This application is related to and claims priority to Russian Patent Application RU 2016152509, filed on Dec. 29, 2016 and Korean Patent Application No. 10-2017-0134786, filed on Oct. 17, 2017, the contents of which are incorporated herein by reference.

TECHNICAL FIELD

Various embodiments of the present disclosure relate to electronic devices, and more particularly, to an electronic device having an antenna unit.

BACKGROUND

Constantly increasing demands of users motivate rapid development of mobile communication technologies. All modern electronic devices capable of accessing the Internet are using 3 Generation (3G) or 4G (e.g., long term evolution (LTE)), and next generation standards are being developed for the users to spend as short time as possible discovering desired information on the Internet.

The 5 Generation (5G) network is a next generation telecommunication network standard. The 5th generation standard operates at millimeter wavelengths, and the 5G signal length is significantly less than that of the 4G signal.

A solution U.S. Pat. No. 8,760,352 B2 (published on Jun. 24, 2014) is known which describes a mobile device and its antenna array. The solution U.S. Pat. No. 8,760,352 B2 discloses a low profile antenna, which has interleaved TX/RX antenna elements, covering end-fire (in the telephone's plane) and broadside (perpendicular to the telephone's plane) direction, and the antenna is made on LTCC technology. However, the solution may not be implemented in a mobile device with a metal case as electromagnetic radiation is distorted by the metal case.

A solution U.S. Pat. No. 3,225,351 (published on Dec. 21, 1965) is known, which describes a vertically polarized microstrip antenna for a glide path system. The solution discloses a traveling wave antenna array for guiding an airplane to a landing strip. However, the solution may not be implemented in the mobile communication technology. This is because it does not use the capability of scanning the space, so it may not work in a mobile device with a metal frame. In addition, since the antenna in this solution provides wavelengths 2-3 times greater than in an embodiment of the present disclosure, it is not proper for the field of mobile communication devices A solution U.S. Pat. No. 7,595,765 B1 (published on Sep. 29, 2009) is known, which describes an embedded surface wave antenna with improved frequency bandwidth and radiation parameters. This solution provides embedded surface wave antenna elements incorporating different dielectric materials. The different dielectric materials may be arranged to be adjacent to a feed line, to avoid undesirable reflections in the antenna elements. Alternatively, different dielectric materials may be arranged to alter the velocity of energy through the antenna element, and thus to form the antenna radiation pattern. The radiation pattern may be further controlled through contouring an antenna element ground plane in a lens region of the antenna element. However, the teachings of present disclosure may be hard to be implemented in the field of mobile communication devices because it is not able to scan the space and has large dimensions. Also, it is designed for radiation basically in the broadside direction, and it is difficult to be embedded into a metal housing of a mobile device.

SUMMARY

To address the above-discussed deficiencies, it is a primary object to provide an electronic device (e.g., a communication device) having an antenna unit, which may be implemented such that traveling waves are excited by an antenna and propagated onto a dielectric substrate and in a dielectric cover, enveloping the metal frame of the housing of the electronic device.

Various embodiments of the present disclosure also provide an electronic device (e.g., a communication device) having an antenna unit, which may be implemented to emit traveling waves in a direction corresponding to the direction along the display plane of the electronic device (e.g., in an end-fire direction).

In accordance with an aspect of the present disclosure, an antenna unit is provided. The antenna unit includes a dielectric substrate; a dielectric cover on the dielectric substrate; an antenna array including antenna elements arranged in the dielectric substrate, and configured to form traveling waves propagating in the dielectric substrate and the dielectric cover; and at least one spatial matching element arranged in space formed inside the dielectric substrate, spatially matched with the dielectric cover, and coupled with the at least one antenna element, wherein the spatial matching element may be spatially matched with the antenna array with the dielectric cover and may reduce reflections of traveling waves propagating from the antenna array to the dielectric cover.

In accordance with another aspect of the present disclosure, an electronic device is provided. The electronic device capable of wireless communication includes a housing of the device with a metal frame; a dielectric substrate arranged in the housing for supporting functional units for wireless communication; a dielectric cover arranged on top of the dielectric substrate; an antenna array including antenna elements arranged in the dielectric substrate, and configured to form traveling waves propagating in the dielectric substrate and the dielectric cover; and at least one spatial matching element arranged in space formed inside the dielectric substrate, spatially matched with the dielectric cover, and coupled with the at least one antenna element, wherein the spatial matching element may be configured to be spatially matched with the antenna array with the dielectric cover and to reduce reflections of traveling waves propagating from the antenna array to the dielectric cover.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
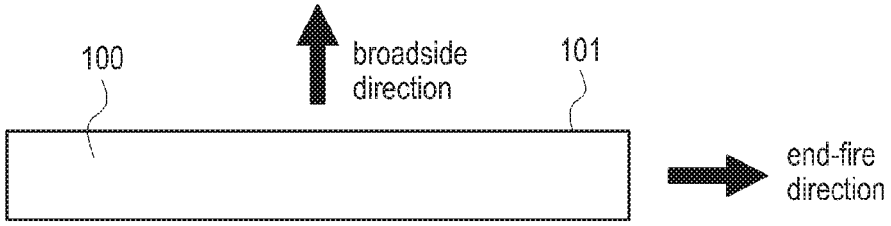
FIG. 1 is a schematic side view of an electronic device having an antenna unit, according to various embodiments of the present disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

The terms "have", "having", "comprise", or "comprising" as herein used specify the presence of disclosed functions, operations, or components, but do not preclude the presence or addition of one or more other functions, operations, or components.

As used herein, the term "A or B", "at least one of A and/or B", or "one or more of A and/or B" includes any and all combinations of one or more of the associated listed items. For example, "A or B", "at least one of A and B", or "at least one of A or B" may indicate (1) at least A, (2) at least B, or (3) at least A and at least B.

Terms like 'first', 'second', etc., may be used to indicate various components, but the components should not be restricted by the terms. These terms are only used to distinguish one element, component, region, layer or section from another element, component, region, layer or section. For example, first user equipment (UE) and second UE may refer to different UEs irrespective of their order or importance. For example, the first component may be termed as the second component, and vice versa, within the scope of the present disclosure.

When it is said that a component (e.g., first component) is operatively or communicatively coupled with/to or connected to another component (e.g., second component), it is to be understood that the first component may be directly connected or coupled to the second component or may be indirectly connected or coupled to the second component via another new component (e.g., third component). However, if a component (e.g., first component) is said to be "directly connected" or "directly coupled" to another component (e.g., second component), it should be interpreted that there is no component (e.g., third component) between the two components.

The expression "configured to" as herein used may be interchangeably used with "suitable for", "having the capacity to", "designed to", "adapted to", "made to", or "capable of" according to the given situation. The expression "configured to" may not necessarily mean "specifically designed to" in terms of hardware. Rather, it may refer to "able to cooperate with" under a certain situation. For example, "a processor configured to perform A, B and C functions" may refer to a dedicated processor, e.g., an embedded processor for performing A, B and C functions, or a general purpose processor, e.g., a Central Processing Unit (CPU) or an application processor that may perform A, B and C functions by executing one or more software programs stored in a memory.

Terms as herein used are merely used for the purpose of explaining some embodiments of the present disclosure and not intended to limit the present disclosure to the embodiments. As used herein, the singular forms "a", "an" and "the" are intended to include the plural forms as well, unless the context clearly indicates otherwise. All terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. The terminology used herein is for the purpose of describing particular embodiments only and is not intended to be limiting of the embodiments of the present disclosure.

In various embodiments of the present disclosure, an electronic device may include at least one of a smart phone, a tablet Personal Computer (PC), a mobile phone, a video phone, an e-book reader, a desktop PC, a laptop PC, a netbook computer, a workstation, a server, a Personal Digital Assistant (PDA), a Portable Multimedia Player (PMP), an MP3 player, a mobile medical device, a camera, and a wearable device. In various embodiments, the wearable device may include at least one of an accessory typed device (e.g., a watch, a ring, a bracelet, an anklet, a necklace, glasses, contact lenses, or a Head-Mounted Device (HMDs)), a cloth or clothing typed device (e.g., electronic clothing), a body-attachable device (e.g., skin pads or tattoos), and an implantable circuit.

In some embodiments, the electronic device may be a home appliance. The home appliance may include at least one of e.g., televisions, Digital Video Disc (DVD) players, audio systems, refrigerators, air conditioners, cleaning machines, ovens, microwaves, washing machines, air purifiers, set-top boxes, home automation control panels, security control panels, TV sets (e.g., Samsung HomeSync™, Apple TV™, or Google TV™), game consoles (e.g., Xbox™, PlayStation™), electronic dictionaries, electronic keys, camcorders, and electronic albums.

In some embodiments, the electronic device may include at least one of a variety of medical equipment (e.g., various portable medical meters (e.g., blood sugar meters, heart rate meters, blood pressure meters, clinical thermometers, etc.), Magnetic Resonance Angiography (MRA), Magnetic Resonance Imaging (MRI), Computed Tomography (CT), photographing devices, ultrasonic devices, etc.), navigation devices, Global Navigation Satellite Systems (GNSSs), Event Data Recorders (EDRs), Flight Data Recorders (FDRs), car infotainment devices, marine electronic devices (e.g., marine navigation systems, gyro-compass, etc.), avionics, security devices, car head units, industrial or home robots, banking agency's Automatic Teller Machines (ATMs), Point of Sales (POSs) for shops, and devices for Internet of things (e.g., bulbs, various sensors, electricity or gas meters, sprinklers, fire alarms, thermostats, street lamps, toasters, health machines, hot-water tanks, heaters, boilers, etc.).

In some embodiments, the electronic device may include at least one of furniture or part of a building/structure, electronic boards, electronic signature receiving devices, projectors, and various instrumental equipment (e.g., meters for water, electricity, gas, or radio waves). The electronic device in accordance with various embodiments of the present disclosure may be one or a combination of the aforementioned various devices. In some embodiments, the electronic device may be a flexible electronic device. The electronic device is not limited to what are described above, but may include a device that would emerge in the future with the advancement of technology.

An electronic device according to various embodiments of the present disclosure will now be described with reference to accompanying drawings. The term "user" as herein used may refer to a person who uses the electronic device or a device (e.g., an artificially intelligent device) that uses the electronic device.

FIG. 1 is a schematic side view of an electronic device having an antenna unit, according to various embodiments of the present disclosure.

Referring to FIG. 1, an electronic device 100 having an antenna unit may be a communication device capable of wireless communication. The electronic device 100 may include a housing 101 and an antenna unit (not shown).

In various embodiments, the housing 101 may include a metal frame, and the antenna unit may be arranged in the housing 101 for providing operation according to 5G, 60 Ghz, WiGig standards and/or others, and thereby providing coverage of the required signal propagation directions of an antenna array of the electronic device 100.

In a structure in accordance with various embodiments of the present disclosure, the broadside is a direction perpendicular to the plane of a display of the electronic device 100 (e.g., a communication device), and end-fire direction is a direction parallel to the plane of the display of the electronic device 100.

In various embodiments of the present disclosure, the main elements of the antenna unit of the electronic device 100 may include a plurality of antenna elements, and a plurality of elements that serve as an antenna array forming traveling waves, dielectric cover, and spatial matching elements of the antenna. The plurality of elements may be arranged on the edge of the traveling wave antenna array and coupled with the antenna elements. The spatial matching elements may convert and redirect radiation into free space in a given direction.

In various embodiments, the antenna element is arranged to be adjacent to the spatial matching element. For example, the spatial matching element may be coupled with the antenna element to make contact with the antenna element. In another example, the antenna element and the spatial matching element may be formed in a substrate in a single manufacturing process, and the spatial matching element may be a waveguide region necessary to form the antenna radiation in a given direction. In yet another example, the antenna element and the spatial matching element may be formed in a printed circuit board of the electronic device 100 in a single manufacturing process of the printed circuit board.

In various embodiments of the present disclosure, the electronic device 100 may enable efficient use of a millimeter wave (mmWave) antenna built in communication devices and other communication devices with a metal housing or a metal housing frame.

In various embodiments, the electronic device 100 or electronic communication device capable of wireless communication and having the antenna unit may be any mobile communication device such as a mobile phone, a tablet computer adapted to perform wireless communication, a laptop, an ultrabook, PDA, a display device capable of wireless communication or any other device having a display and the capability of adopting an antenna array in a housing of the electronic device 100.

The antenna unit may be embedded in a communication unit of the electronic device 100. For example, the communication unit of the electronic device 100 may include a radiation source, a power supply unit, a data output unit, a user input unit and other units necessary for realization of its purpose. The radiation source may transmit and receive user input signals, and may include data converters for converting data received from the user into signals suitable for transmission to an appropriate receiving apparatus. The data output unit may, for example, comprise a display showing the data necessary for communication to the user and a loudspeaker. The user input unit may include a microphone, a keyboard, a display and any other unit suitable for receiving data from the user and direction of data to the communication unit. The power supply unit may supply power for operation of the aforementioned units.

With the use of the traveling wave antenna in accordance with various embodiments, the waves envelop the metal housing of the electronic device 100, thereby providing radiation in the end-fire direction. In another example, the electronic device 100 may be implemented without need for any ports or discontinuities in the metal housing that would impair integrity of the housing.

Figure 2A:
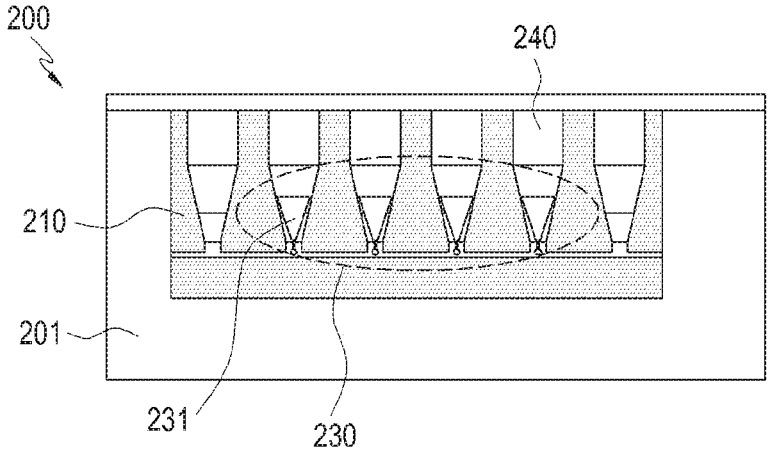
FIG. 2A is a top view of a part of an electronic device representing an antenna unit having a structure of an antenna array, according to various embodiments of the present disclosure.
Figure 2B:
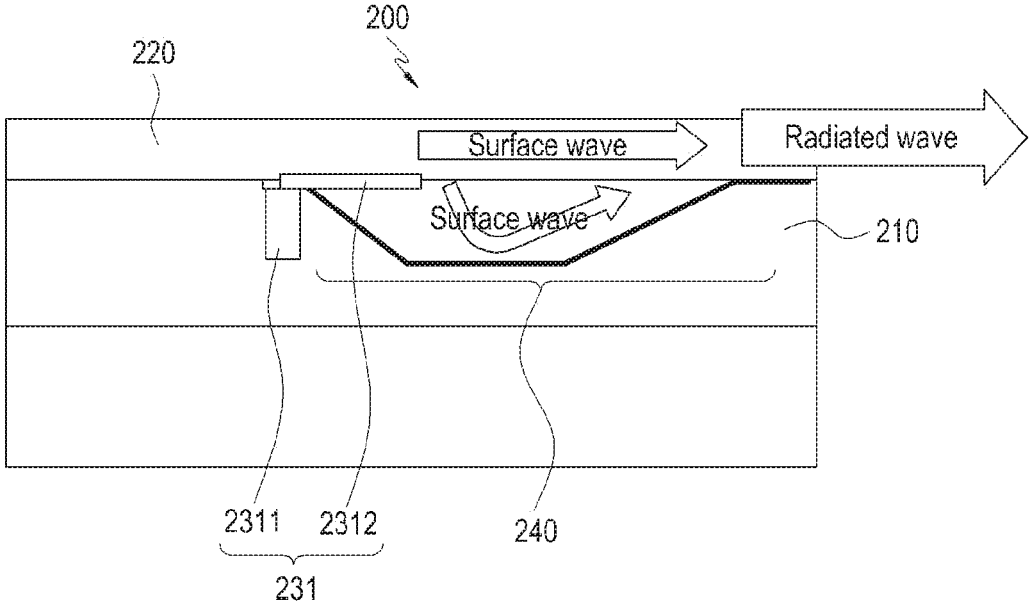
FIG. 2B is a cross-sectional view of a part of an electronic device representing a side of an antenna unit having a structure of an antenna array, according to various embodiments of the present disclosure.

FIG. 2A is a top view of a part of an electronic device 200 representing an antenna unit having a structure of an antenna array 230, according to various embodiments of the present disclosure. FIG. 2B is a cross-sectional view of the part of the electronic device 200 representing a side of the antenna unit having the structure of the antenna array 230, according to various embodiments of the present disclosure.

Referring to FIGS. 2A and 2B, the electronic device 200 may include a housing 201 and an antenna unit. The housing 201 may be formed of a metal substance. The antenna unit may include a dielectric substrate 210, a dielectric cover 220 arranged on top of the dielectric substrate 210, the antenna array 230 including at least one antenna element 231, and an element for spatial matching (or called spatial matching element) 240 arranged in the space formed inside the dielectric substrate 210.

In various embodiments, the dielectric substrate 210 may be, for example, a printed circuit board, and may include operation units for performing wireless communication of the electronic device 200.

In various embodiments, the dielectric cover 220 may be arranged on the edge of the antenna array 230 and coupled with the at least one antenna element 231. The dielectric substance of the dielectric cover 220 may be, for example, a display of the electronic device 200, and may operate as a dielectric waveguide that covers the antenna array 230 which is a set of the antenna elements 231. The dielectric waveguide may serve as traveling wave emitters.

In various embodiments, the dielectric cover 220 may have dielectric permittivity that is higher than the material of the dielectric substrate 210 that supports the antenna elements 231 and the spatial matching elements (e.g., spatial converters), and provide a slowing structure for electromagnetic waves excited by the antenna array 230. Therefore, if conditions for the cover defined as the dielectric waveguide (e.g., parameters of dielectric permittivity and height of the cover) are met, the excited electromagnetic waves may be successfully directed in the end-fire direction in the structure of the dielectric cover 220 and radiation in the broadside direction may be reduced.

In various embodiments, the antenna array 230 may include the plurality of antenna elements 231 arranged on the dielectric substrate 210, forming traveling waves propagating onto the dielectric substrate 210 and the dielectric cover 220. The antenna element 231 may include a feed line 2311, e.g., coaxial feeding, electrically connected to the power supply unit, and an antenna patch 2312 extending from the feed line 2311 to radiate the traveling waves.

In various embodiments, the antenna elements 231 may adjoin the spatial matching element 240. For example, the spatial matching element 240 may make contact with the antenna elements 231 or may be coupled with at least some of the antenna elements 231. In another example, the antenna elements 231 may be microstrip antenna elements. As described above, the antenna elements 231 and the spatial matching element 240 may be formed in a substrate in a single manufacturing process, and the spatial matching element 240 may provide a waveguide region necessary to form antenna radiation in a given direction. In yet another example, the antenna elements 231 and the spatial matching element 240 may be formed in a printed circuit board of the electronic device 200 in a single manufacturing process of the printed circuit board.

In various embodiments, the spatial matching element 240 may be spatially matched with the dielectric cover 220, and coupled with the at least one antenna element 231. The spatial matching element 240 may be a dielectric waveguide region required to form antenna radiation in a certain direction with the antenna elements 231 and may be formed in the dielectric substrate 210 in a single manufacturing process. For example, the spatial matching element 240 and the antenna elements 231 may be formed in the printed circuit board of the electronic device 200 in the single manufacturing process of the printed circuit board.

In various embodiments, there may be a plurality of spatial matching elements 240 and they may be arranged to be adjacent to each other. The spatial matching elements 240 may match and correspond to the antenna elements 231, respectively.

In various embodiments, the spatial matching elements 240 may be arranged such that at least some regions of the respective elements are joined, thereby providing a single matching region. For example, the respective spatial matching elements 240 may be joined such that they are not partitioned (e.g., such that there are no walls between the respective matching elements), forming a large spatial matching unit. The spatial matching elements 240 may be coupled with the antenna elements 231, respectively, to radiate electromagnetic waves. The spatial matching unit forming the single common region may allow antenna radiation to be redirected in a given direction without distortion.

In various embodiments, the spatial matching element 240 may be spatially matched with the antenna array 230 with the dielectric cover 220, and may reduce reflection of traveling waves propagated from the antenna array 230 to the dielectric cover 220. For example, the spatial matching element 240 for spatially matching the dielectric cover 220 (e.g., the display) and the radiation space (e.g., outside fee space of the electronic device 200) with the antenna array 230 may act as an electromagnetic wave spatial converter.

In various embodiments, the spatial matching element 240 may have a trapezoidal cross-section for best matching with the dielectric cover 220 (e.g., the display and the metal housing) and the microstrip antenna element 231. The shape of the spatial matching element 240 is, however, not limited to the trapezoidal form, but may have any other geometric shape allowing appropriate spatial matching, such as the form having some gradually expanding region. For example, the trapezoidal shape and/or other geometric shape of spatial matching element 240 may be implemented by milling of the dielectric substrate 210, molding of the dielectric substrate 210 or other various manufacturing technologies. In another example, the spatial matching element 240 may be designed to have a recess or a cavity formed in the substrate and subsequently filled with a dielectric material, to make the spatial matching element 240 to be spatially matched with the dielectric cover 220.

In various embodiments, to form the spatial matching element 240 to be spatially matched with the dielectric cover 220, the recess may be provided in a metalized layer, forming the antenna dielectric substrate 210 with the recess filled with the dielectric material. In another example, the spatial matching element 240 may be implemented by forming a recess or a cavity in a printed circuit board that is free of metal and metallizing the surface.

In various embodiments, the metal spatial matching element 240 may be the recess filled with a dielectric material matched with the dielectric cover 220, and a metalized cover may be arranged on the surface of the recess filled with the dielectric material.

Figure 3:
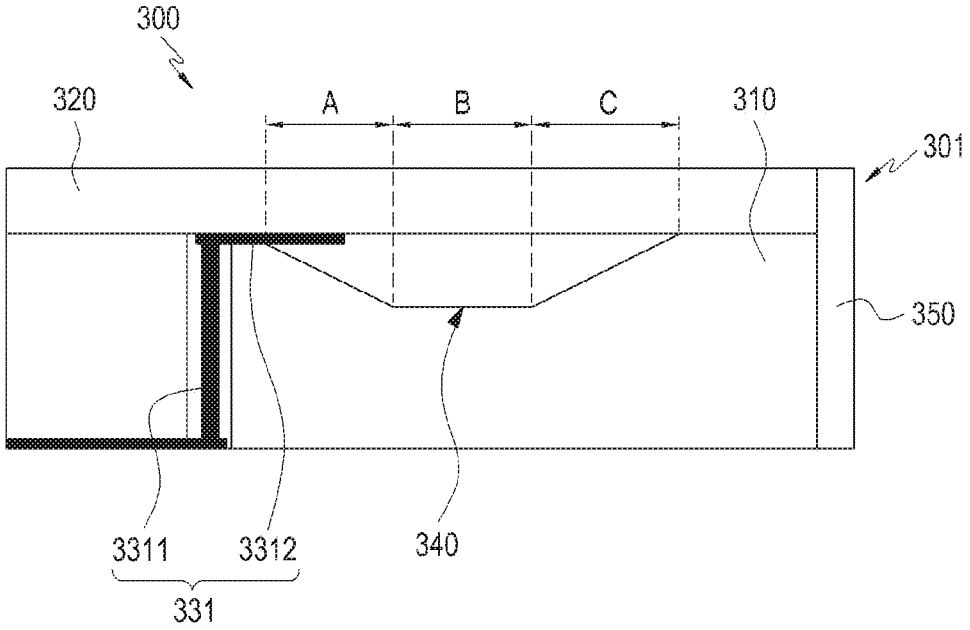
FIG. 3 is a cross-sectional view of a part of an electronic device representing an antenna unit having a spatial matching element, according to various embodiments of the present disclosure.

FIG. 3 is a cross-sectional view of a part of an electronic device representing an antenna unit having a spatial matching element, according to various embodiments of the present disclosure.

Referring to FIG. 3, an electronic device 300 may include a housing 301 and an antenna unit. The housing 301 may be formed of a metal substance. The antenna unit may include a dielectric substrate 310, a dielectric cover 320 arranged on top of the dielectric substrate 310, an antenna array, e.g., the antenna array 230 of FIG. 2, including at least one antenna element 331, and an element for spatial matching (or called spatial matching element) 340 arranged in the space formed inside the dielectric substrate 310.

In various embodiments, the antenna unit is capable of wireless communication, and may further include a metal frame 350 formed such that the wavelengths propagated from the dielectric cover 320 are matched with radiation space.

In various embodiments, a cross-section of the metal spatial matching element 340 has a trapezoidal form including a first part A, a second part B, and a third part C. The first part A may be configured to match the antenna element 331 of the antenna array with a traveling wave transmission path, ensuring the minimum standing-wave ratio by means of smooth transition of radiation. For example, the radiation may travel to the dielectric cover 320 from the antenna element 331 of the antenna array by transformation of one of radiation lines to another. The second part B may be a dielectric waveguide. The third part C may be configured to provide minimum reflections from the borders of the spatial matching element 340 and the dielectric cover 320

Figure 4:
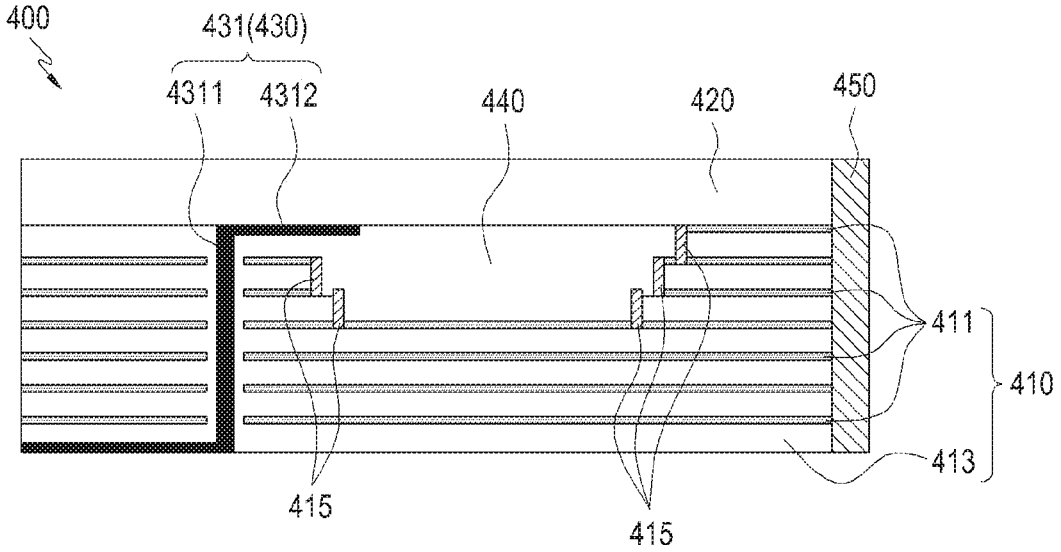
FIG. 4 is a cross-sectional view of a part of an electronic device representing an antenna unit having a spatial matching element, according to various embodiments of the present disclosure.

FIG. 4 is a cross-sectional view of a part of an electronic device representing an antenna unit having a spatial matching element, according to various embodiments of the present disclosure.

Referring to FIG. 4, an electronic device 400 may include a housing 401 and an antenna unit. The housing 401 may be formed of a metal substance. The antenna unit may include a dielectric substrate 410, a dielectric cover 420 arranged on top of the dielectric substrate 410, the antenna array 430 including at least one antenna element 431, and an element for spatial matching (or called spatial matching element) 440 arranged in the space formed inside the dielectric substrate 410. The dielectric substrate 410 may have multiple layers, including a plurality of metal coated layers 411 and a plurality of dielectric layers 413 arranged between the plurality of metal coated layers 411.

In various embodiments, metalization process on the surface of a recess or a cavity forming the spatial matching element 440 may not be an essential process, and may be replaced by other possible embodiments, such as a metal-free spatial matching element 440.

In various embodiments, the spatial matching element 440 matching with the antenna array 430 and the dielectric cover (e.g., the display) may be formed in the multiple-layered dielectric substrate 410 of the electronic device 400. For example, the multi-layered dielectric substrate 410 may be implemented in the electronic device 400 by sequentially applying a plurality of dielectric layers 413 including the metal coated layer 411 according to a known manufacturing technology of printed circuit boards, and the antenna element 431 of the antenna array and the spatial matching element 440 may be formed on the inner side of and/or adjacent to the multi-layered dielectric substrate 410.

In various embodiments, the trapezoidal spatial matching element 440 spatially matched with the dielectric cover 420 such as the display may be formed in the multi-layered printed circuit board by sizing and configuring the dielectric layers 413 and the metal coated layers 411 of the printed circuit board, along the cross-section of the spatial matching element 440. In another example, there are metallized via-holes 415 arranged between adjacent layers of the metal coated layers 411, which may block passage of waves between the layers of the dielectric substrate 410.

In various embodiments, the antenna unit and the electronic device 400 including the antenna unit may have the following advantages:

providing a high-gain antenna;

providing improved scanning in the end-fire direction within the range of +/−50 degrees, wherein the extension of the scanning range may be related to the slowing properties of the dielectric cover 420 for the waves excited by the antenna element 431.

In various embodiments, directivity of the traveling wave antenna in the end-fire direction may be improved by supporting the surface waves, and beam scanning in the end-fire plane may be enhanced without scanning losses due to electromagnetic waves propagating in the dielectric cover 420.

In various embodiments, the metal frame 450 of the housing of the electronic device 400 may be used for matching the antenna unit with the radiation space. For example, using a traveling wave may allow radiation to envelop the metal frame 450 and effectively propagate in the end-fire direction.

The phases of the antenna elements 431 of the antenna array may be calculated on the basis of considerations of forming the maximum of the radiation pattern and the flat phase front in the desired direction of radiation. The directivity of an antenna may be provided by keeping required phase relations between elements of the antenna unit and the surface wave forming conditions.

Figure 5:
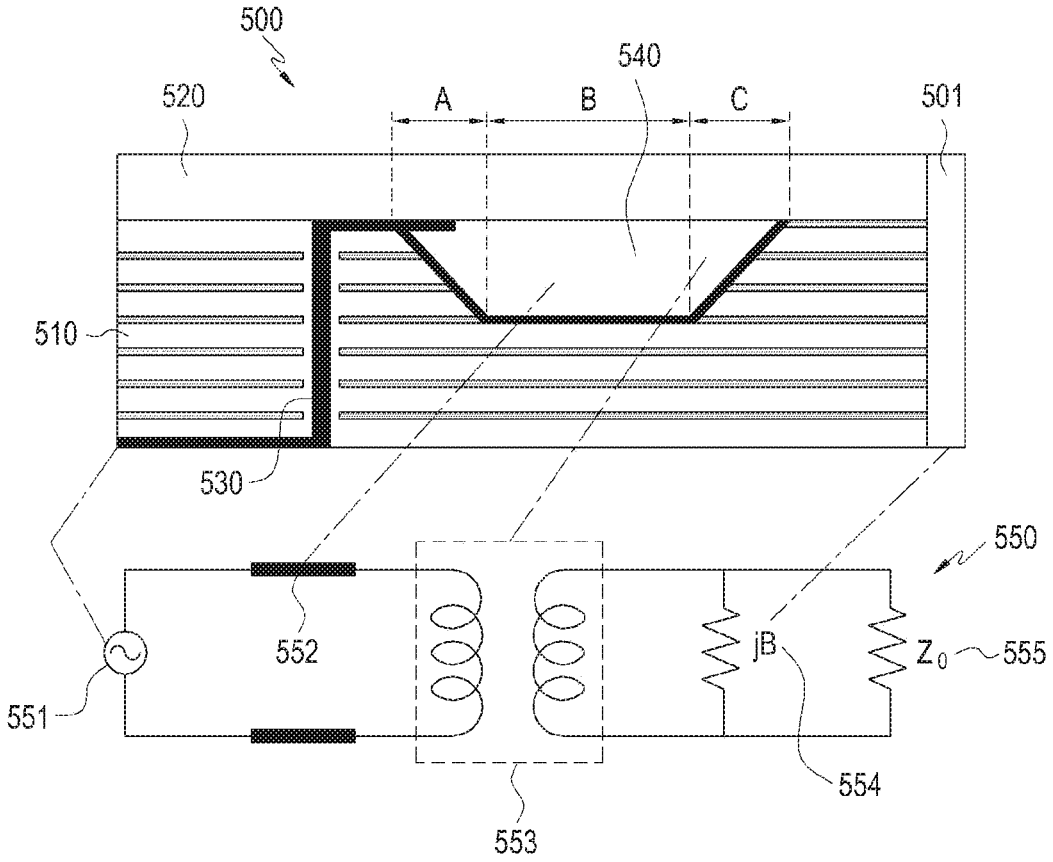
FIG. 5 is a side view representing relationships between elements of an antenna unit and an equivalent electric circuit, according to various embodiments of the present disclosure.
Figure 6:
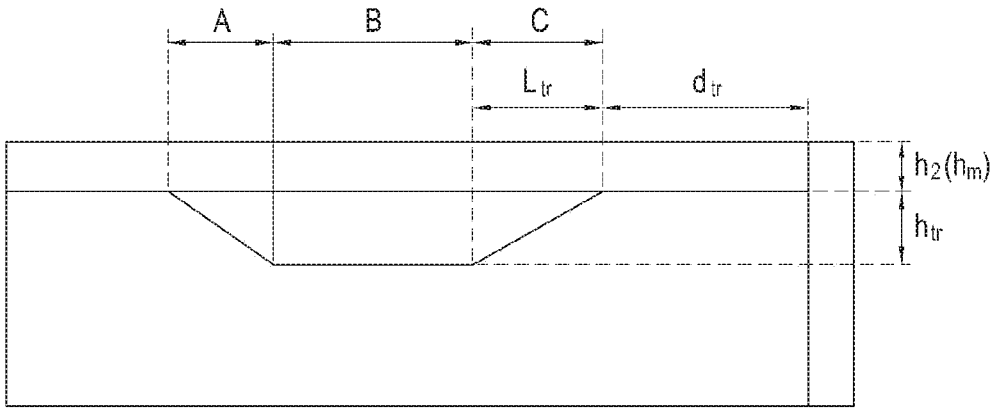
FIG. 6 is a side view representing geometric parameters of an antenna unit, according to various embodiments of the present disclosure.

FIG. 5 is a side view representing relationships between elements of an antenna unit and an equivalent electric circuit, according to various embodiments of the present disclosure. FIG. 6 is a side view representing geometric parameters of an antenna unit, according to various embodiments of the present disclosure.

Referring to FIGS. 5 and 6, an electronic device 500 may include a housing 501 and an antenna unit. The housing 501 may be formed of a metal substance. The antenna unit may include a dielectric substrate 510, a dielectric cover 520, the antenna array 530 including at least one antenna element 530, and an element for spatial matching (or called spatial matching element) 540 arranged in the space formed inside the dielectric substrate 510. How the elements of the proposed antenna unit and the equivalent electric circuit relate and operate will now be described.

In various embodiments, the antenna unit may include the dielectric substrate 510, e.g., a printed circuit board accommodating an array of traveling wave microstrip antenna elements 530 excited by striplines formed in the printed circuit board. Each of the stripline antenna elements 530 may be able to excite traveling waves propagating in the spatial matching element 540. For example, the spatial matching element 540 may be a spatial converter and may be arranged between the dielectric substrate 510 and the dielectric cover 520 (e.g., the display). The traveling waves are radiation enveloping the metal frame of the housing 501 and may be radiated toward a base station.

In various embodiments, the spatial matching element 540 (e.g., spatial converter) may include three parts. For example, the spatial matching element 540 may include a first part A, a second part B, and a third part C, and the first part A may match the stripline antenna element 531 with a transmission path comprised of the dielectric cover 520 and the dielectric substrate 510. The second part B may be a permanent part of the spatial converter and a dielectric waveguide, and the third part C may match the antenna with the dielectric cover 520 and the outside radiation space.

In various embodiments of the present disclosure, all parameters of the first part A of the spatial matching element 540 may be determined for reasons of ensuring the minimum standing-wave ratio (SWR) of specific elementary emitters used in the antenna array 530.

Referring to FIG. 6, the height $H_{tr}$ of the first part A of the spatial matching element 540 may be generally determined by standard ratios of the elevation of the microstrip emitters and may be, for example, within $\lambda_1/4$–$\lambda_1/2$.

The second part B may correspond to a portion of the waveguide structure of the spatial matching element 540, and in general, its length may be approximately a quarter wavelength ($\lambda_1/4$) or more. In another example, the longer the length is, the more directional the antenna unit may be.

Parameters of the third part C may be determined from an equivalent circuit 550 in order to ensure or provide minimum reflections on the border of the waveguide structures. The form of the third part C may be implemented to provide smooth output of electromagnetic waves. Actually, the frame of the housing 501 of electric devices, e.g., a communication device, may be made of metal, and if a structure, such as a metal frame of the device housing is in the direction of the antenna radiation, then the parameters of the third part C of the spatial matching element 540 may be calculated based on the equivalent circuit 550 shown in FIG. 5.

In various embodiments, the traveling wave antenna with the wavelength propagating in the dielectric forming the spatial matching element 540 may have a large reactive component of the output resistance and may be consistent with the outside radiation space. Metal elements such as a metal frame of the device housing on the end of the dielectric may be used for effective compensation of this reactive component of the output impedance and for providing directional radiation into the outside radiation space. For example, a step formed in the metal object may provide matching reactivity.

In various embodiments, if the step has a value greater than $\lambda/8$ in the air, the thickness of the frame of the housing 501 of the metal housing may no longer have any influence. In another example, if the step may be varied by the manufacturer to have a value equal to or smaller than $\lambda/8$, it may be considered in optimization analysis.

Turning back to FIG. 6, to determine the parameters of the metal elements, the equivalent traveling wave antenna circuit 550 may be used. For example, the antenna element 530 of the antenna unit (e.g., the microstrip emitter) may be presented by a signal source 551 of the equivalent circuit 550, and a region of the second part B of the spatial matching element 540 (e.g., the spatial converter) of the antenna unit may be presented by a waveguide 552 of the equivalent circuit 550. In another example, a region of the third part C of the spatial matching element 540 of the antenna unit (e.g., the spatial converter) of the antenna unit may be presented by a transformer 553, and the metal element (e.g., metal frame of the housing 501) of the antenna unit may be presented by output matching impedance 554 of the equivalent circuit 550. The impedance $Z_0$ 555 of the equivalent circuit 550 may be environmental resistance.

Turning back to FIG. 6, in the aforementioned structure, $h_2$ refers to the height of the dielectric cover 520, $h_{tr}$ refers to the height of the spatial matching element 540 spatially matching with the dielectric cover 520, and $h_m$ refers to the height of the metal frame of the electronic device 500 relative to a plane in which the antenna element 530 is located (which generally corresponds to the surface of the dielectric substrate of the antenna).

In various embodiments, reactivity (jB) may be determined based on the approximate values of the parameters of the spatial matching elements, and specific parameters, such as $L_{tr}$ and $d_{tr}$ may be obtained. They may be used for optimization of all the antenna unit parameters. $L_{tr}$ refers to the length of the third part C of the spatial matching element 540, and $d_{tr}$ refers to the distance from the third part C of the spatial matching element 540 for spatially matching with the dielectric cover 520 to the metal frame of the electronic device 500.

The result of an optimization process on the parameters of the antenna unit elements will be minimizing the reflection factor of the antenna elements and maximizing the gain factor across the antenna array. The optimization algorithms may be used from various known technologies.

In various embodiments, the metal frame of the housing 501 may match the outside space and the antenna with respect to the plane in which the antenna element 530 is located. The height $h_m$ of the metal frame of the housing 501 may coincide with the thickness of the dielectric cover 520, e.g., the display. However, the thickness may be smaller or greater than the thickness of the dielectric cover 520 but not more than $\lambda_1/10$.

In various embodiments, the materials forming the dielectric cover 520 and the dielectric substrate 510 may have a ratio of different dielectric permittivities. For example, if the dielectric cover 520 may have first dielectric permittivity $\varepsilon_1$, and the dielectric substrate 510 may have second dielectric permittivity $\varepsilon_2$, and the first and second dielectric permittivities $\varepsilon_1$ and $\varepsilon_2$ may be equal or different ($\varepsilon_1>\varepsilon_2$, $\varepsilon_1<\varepsilon_2$ or $\varepsilon_1=\varepsilon_2$).

In various embodiments, the dielectric cover 520 having the first dielectric permittivity $\varepsilon_1$ may include e.g., glass or other dielectric material. The first dielectric permittivity $\varepsilon_1$ of the dielectric cover 520 may be higher than the second dielectric permittivity $\varepsilon_2$ of the dielectric substrate 510 accommodating the antenna element. The dielectric filling the spatial matching element 540 spatially matched with the dielectric cover 520 may have the same dielectric permittivity (e.g., the second dielectric permittivity $\varepsilon_2$) as the dielectric substrate 510.

With such a ratio, the slowing effect of the dielectric cover 520 is realized, thereby maintaining the electromagnetic waves traveling in the thickness of the dielectric cover 520 and reducing loss of electromagnetic waves in the broadside direction.

In various embodiments, to provide an optimal process of guiding the surface wave in the dielectric cover 520, the height $h_{tr}$ of the spatial matching element spatially matched with the dielectric cover 520 may be about a quarter wavelength $\lambda_2/4$, and $L_{tr}+d_{tr}$ may be approximately equal to the effective wavelength $\lambda_{eff}$. The wavelength $\lambda_1$ refers to a wavelength in the dielectric filling the spatial matching element (the spatial converter) spatially matching the antenna element and the dielectric cover with dielectric permittivity $\varepsilon_2$, the wavelength $\lambda_2$ refers to a wavelength in the dielectric filling the spatial matching element (the spatial converter) spatially matching the antenna element and the dielectric cover with dielectric permittivity $\varepsilon_2$, and $\lambda_{eff}$ refers to a wavelength in the dielectric volume with dielectric permittivity $\varepsilon_{eff}$.

Dielectric permittivity $\varepsilon_{eff}$ may be defined as follows:

$$\varepsilon_{eff} = \frac{\varepsilon_2 h_{tr} + \varepsilon_1 h_2}{h_{tr} + h_2} \tag{1}$$

Referring to equation 1 and FIG. 6, the dielectric permittivity $\varepsilon_{eff}$ may provide the value of dielectric permittivity of a case for radiation moving through two dielectrics having dielectric permittivities $\varepsilon_1$ and $\varepsilon_2$. The first dielectric with $\varepsilon_1$ may be the dielectric cover of the display, and the second dielectric with $\varepsilon_2$ may be the dielectric material filling the recess of the spatial matching element spatially matched with the dielectric cover (e.g., the display). The dielectric cover may have the same material as the dielectric material of the substrate.

The $\varepsilon_{eff}$ may be used for determining the effective wavelength $\lambda_{eff}$, and used for determining the distance $d_{tr}$ to the metal housing frame.

In various embodiments, since the dielectric cover has dielectric permittivity $\varepsilon_1$, which is greater than the dielectric permittivity $\varepsilon_2$ of the dielectric substrate of the antenna, the dielectric cover may form a delay layer which holds electromagnetic surface waves in the dielectric and prevents premature radiation in the transverse direction.

The surface wave in the dielectric cover may be added to the electromagnetic wave in the spatial matching element spatially matched with the dielectric cover and may be emitted from the edge of the dielectric cover.

In various embodiments, the spatial matching element of antenna integrated into the dielectric cover may provide better propagation of the waves without excessive propagation losses.

The combination of the dielectric cover and the spatial matching antenna element may improve directional properties of the proposed stripline antenna elements in the end-fire direction and increase antenna gain. In another example, the combination may provide a wider scanning range of the radiation pattern in azimuth plane without losses that take place especially for antenna arrays with smaller number of elements (e.g. with four elements). For example, the combination may form radiation directivity.

In various embodiments, if the electronic device does not have a metal frame or the metal frame is well below the location of the antenna elements and the bottom surface of the display ($>\lambda/4-\lambda/2$), then free space matching reactivity may be managed in other ways, for example using matching stubs etc. In the embodiments of a device without the metal housing frame, the free space matching may be achieved due to the form of the third part C of the spatial matching element (the spatial converter) spatially matched with the dielectric cover.

Such embodiments may ensure or provide functioning of the device of the present disclosure as described above and achieve the same advantageous effects that individually and collectively provide better communication of the communication device with the base station.

Figure 7:
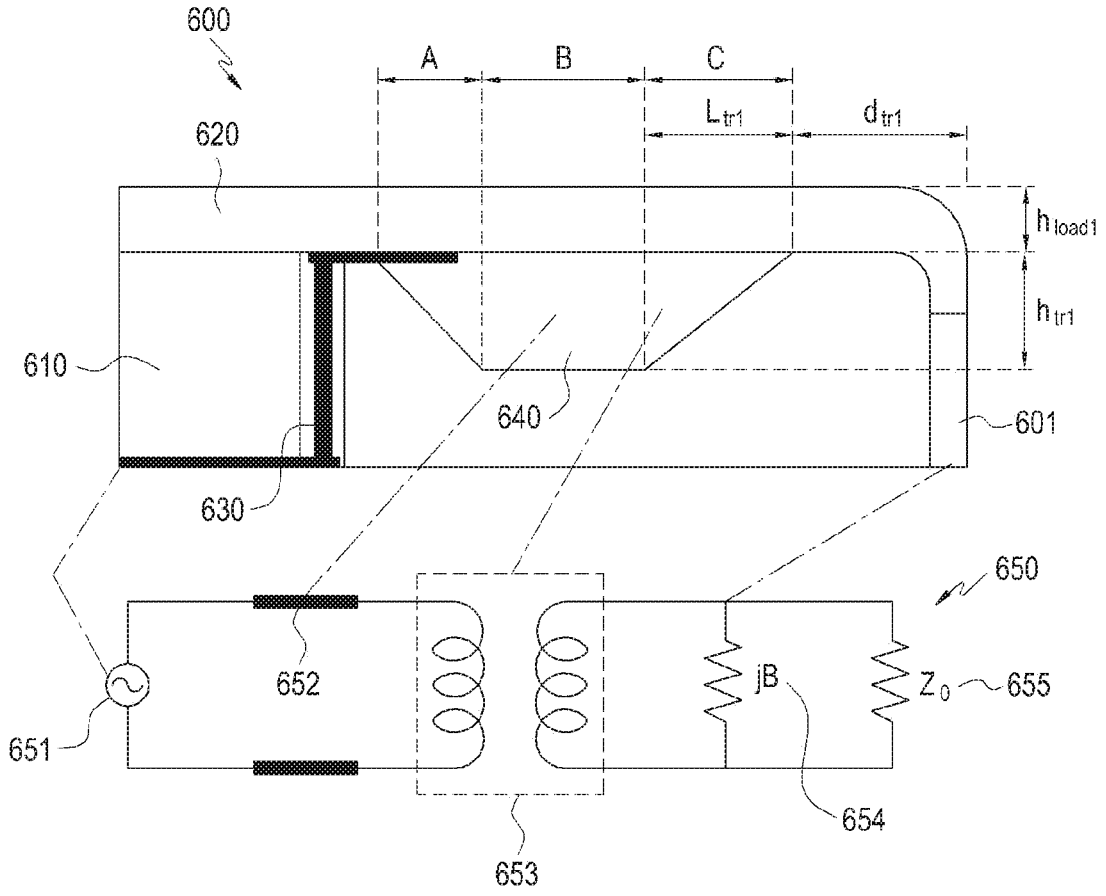
FIG. 7 is a side view representing relationships between elements of an antenna unit and an equivalent electric circuit, according to various embodiments of the present disclosure.

FIG. 7 is a side view representing relationships between elements of an antenna unit and an equivalent electric circuit, according to various embodiments of the present disclosure.

Referring to FIG. 7, an electronic device 600 may include a housing 601 and an antenna unit. The housing 601 may be formed of a metal substance. The antenna unit may include a dielectric substrate 610, a dielectric cover 620, the antenna array 630 including at least one antenna element 630, and an element for spatial matching (or called spatial matching element) 640 arranged in the space formed inside the dielectric substrate 510.

In various embodiments, the housing 601 of the electronic device 600 may form rounded edges. For example, the electronic device 600 may include a dielectric cover (e.g., the display) with rounded edges. If the dielectric cover is manufactured to have a bending form, the antenna element 630 and other elements may not be altered as compared to the aforementioned dielectric cover (e.g., the dielectric cover 520 of FIG. 5), and may be calculated according to the same equation 1.

In various embodiments, to provide an optimal process of guiding the surface wave in the dielectric cover 620, the height $h_{tr}$ of the spatial matching element spatially matching with the dielectric cover 620 may be about a quarter wavelength $\lambda_2/4$, and $L_{tr}+d_{tr}$ may be approximately equal to the effective wavelength $\lambda_{eff}$.

In various embodiments, to determine parameters of the metal elements, an equivalent traveling wave antenna circuit 650 may be used. For example, the antenna element 630 of the antenna unit (e.g., the microstrip emitter) may be presented by a signal source 651 of the equivalent circuit 650, and a region of the second part B of the spatial matching element 640 (e.g., the spatial converter) of the antenna unit may be presented by a waveguide 652 of the equivalent circuit 650. In another example, a region of the third part C of the spatial matching element 640 of the antenna unit (e.g., the spatial converter) of the antenna unit may be presented by a transformer 653, and the metal element (e.g., metal frame of housing 601) of the antenna unit may be presented by output matching impedance 654 of the equivalent circuit 650. The impedance $Z_0$ 655 of the equivalent circuit 650 may be environmental resistance.

Figure 8:
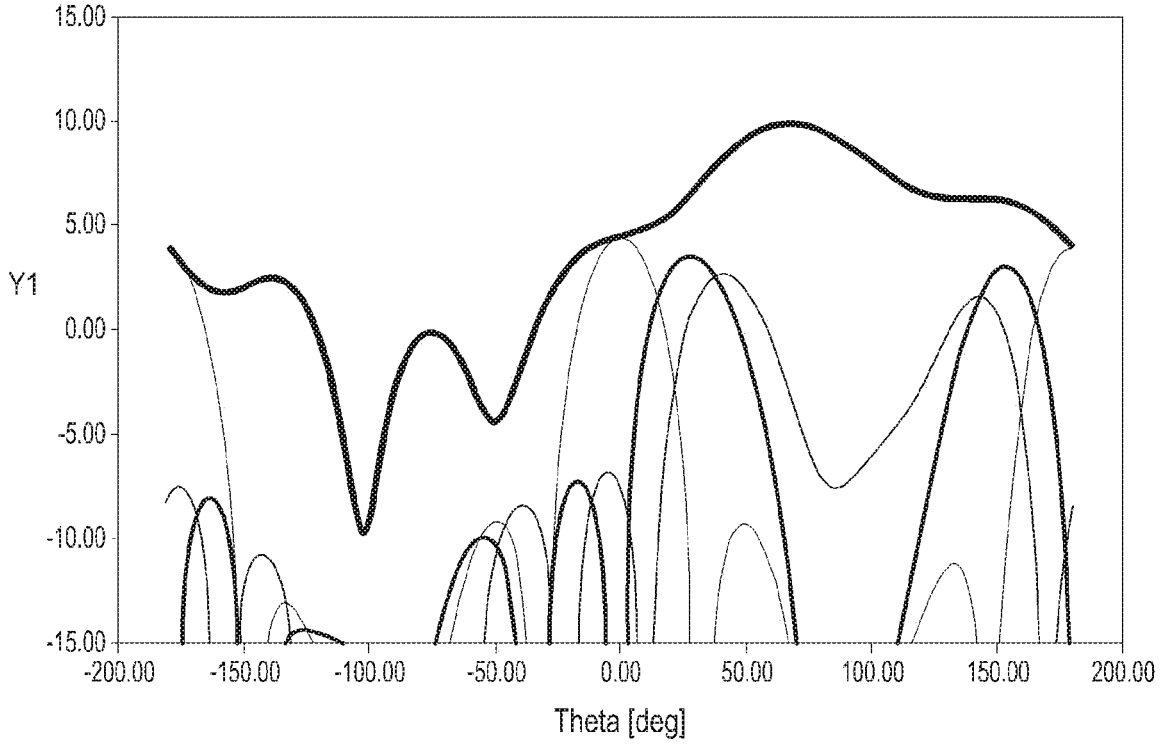
FIG. 8 is a graph of antenna gains depending on radiation directions in a case that the antenna is not matched with the outside space, according to various embodiments of the present disclosure.
Figure 9:
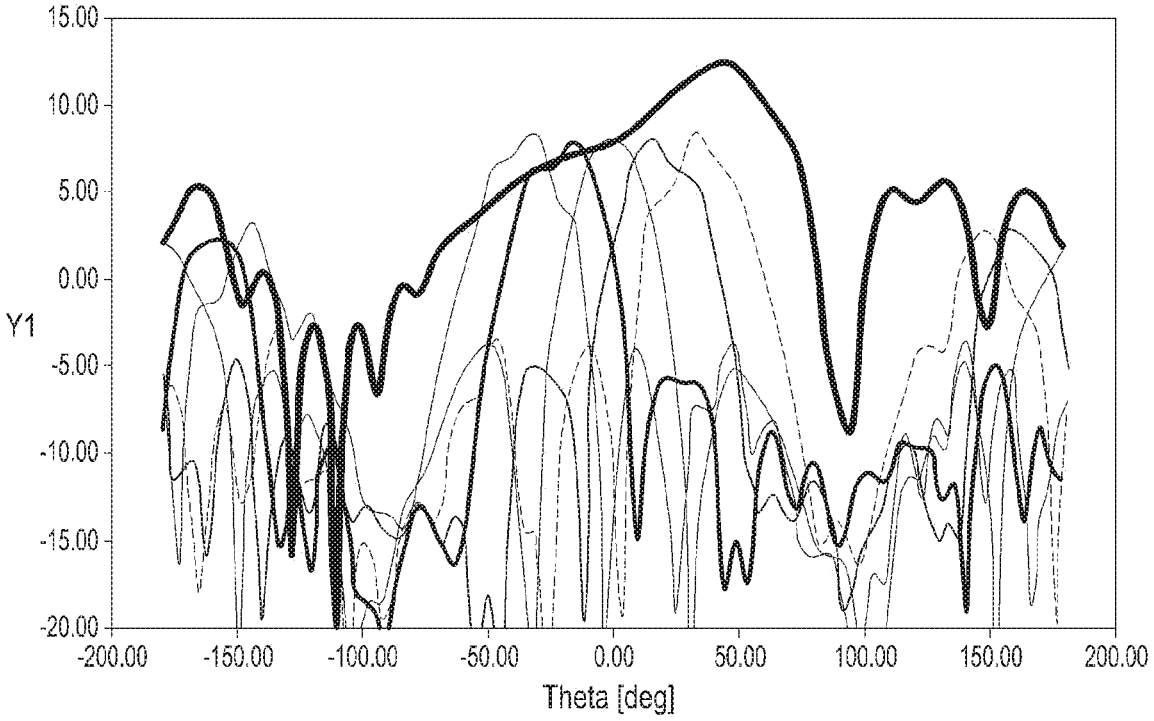
FIG. 9 is a graph of antenna gains depending on radiation directions in a case that the antenna is matched with the outside space, according to various embodiments of the present disclosure.

FIG. 8 is a graph of antenna gains depending on radiation direction in a case that the antenna is not matched with the outside space, according to various embodiments of the present disclosure. FIG. 9 is a graph of antenna gains depending on radiation direction in a case that the antenna is matched with the outside space, according to various embodiments of the present disclosure.

Referring to FIGS. 8 and 9, a radiation direction of 0 degree refers to an end-fire direction, and a radiation direction of +90 degrees refers to a broadside direction of the electronic device.

In various embodiments, with the aforementioned structures, it may be seen that antenna gains increase in the end-fire direction as compared with the traditional technologies. For example, the antenna gain is about 4.5 dB in the end-fire direction of FIG. 8 and the antenna gain is about 8 dB in the end-fire direction of FIG. 9. In an embodiment of the present disclosure, the antenna gain in the end-fire direction is nearly doubled the traditional technologies. In another example, with the structure in accordance with an embodiment of the present disclosure, it may be seen that approximately +/−50 degrees of scanning range is provided.

Referring to FIGS. 8 and 9, with the structure in accordance with an embodiment of the present disclosure, the radiation in the direction of 90 degrees becomes minimum while the radiation in the direction of 90 degrees becomes maximum in the traditional technology.

The embodiments are not limited to those as described above, and a person skilled in the art may appreciate other embodiments based on the information contained herein and the knowledge in the art without departing from the spirit and scope of the present disclosure. The elements referred to in the singular do not exclude a plurality of the elements, unless specifically stated otherwise.

The functional connection of the elements should be understood as the connection that ensures or provides the correct interaction of these elements with each other and implementation of functionality of the elements. Specific examples of the functional connection may be connection with the possibility of data exchange, connection with the possibility of transmitting an electric current, connection with the possibility of mechanical movement, connection with the possibility of transmission of light, sound, electromagnetic or mechanical vibrations etc. The specific type of the functional connection is determined by interaction of said elements, and, unless otherwise specified, is provided by well-known means, using the principles well-known in the art.

Various embodiments of the present disclosure do not describe any specific software and hardware for implementing the blocks in the figures, but a person skilled in the art will appreciate that the essence of the disclosure is not limited to a particular hardware or software implementation, and therefore, any hardware or software means known in the art may be used for implementing the embodiments of the present disclosure. Thus, hardware may be implemented within one or more application specific integrated circuits (ASICs), digital signal processors (DSPs), DSP devices, programmable logic devices, field programmable gate arrays (FPGAs), processors, controllers, microcontrollers, microprocessors, electronic devices, other electronic modules configured to perform the functions described herein, a computer, or a combination thereof.

Features mentioned in different dependent claims and the embodiments disclosed in the various parts of the description may be combined to achieve advantageous effects, even if the possibility of such a combination is not explicitly disclosed. Any numerical values indicated in the materials of the present description or in the figures, are intended to include all values from the lower value to the upper value of the mentioned ranges.

Despite the fact that the exemplary embodiments have been described in details and illustrated in the accompanying drawings, it should be understood that such embodiments are merely illustrative and are not intended to limit the broader inventions, and that the present disclosure should not be limited to the specific illustrated and described layouts and designs, since various other modifications will be apparent to those skilled in the art.

In various embodiments of the present disclosure, an antenna unit includes a dielectric substrate; a dielectric cover on the dielectric substrate; an antenna array including antenna elements arranged in the dielectric substrate, and configured to form traveling waves propagating in the dielectric substrate and the dielectric cover; and at least one spatial matching element arranged in space formed inside the dielectric substrate, spatially matched with the dielectric cover, and coupled with the at least one antenna element, wherein the spatial matching element may be spatially matched with the antenna array with the dielectric cover and may reduce reflections of traveling waves propagating from the antenna array to the dielectric cover.

In various embodiments, the antenna unit may further include a metal frame formed to enable wireless communication and allow wavelengths propagated from the dielectric cover to be matched with radiation space.

In various embodiments, the antenna array may be formed by stripline antenna elements.

In various embodiments, the at least one of the spatial matching elements spatially matched with the dielectric cover may have a trapezoidal shape in the cross section.

In various embodiments, the at least one of the spatial matching elements spatially matched with the dielectric cover includes a first part, a second part, and a third part, the first part being configured to match the antenna array with the dielectric cover, ensuring the minimum standing-wave ratio by transition of radiation from the antenna array into the dielectric cover, the second part being a dielectric waveguide, and the third part being configured to provide minimum reflections from the borders of the third part is configured to provide minimum reflections from the borders of the spatial matching element spatially matched with the dielectric cover.

In various embodiments, the dielectric cover may have first dielectric permittivity $\varepsilon_1$ and the dielectric substrate may have second dielectric permittivity $\varepsilon_2$, and the first dielectric permittivity $\varepsilon_1$ may be higher than the second dielectric permittivity $\varepsilon_2$.

In various embodiments, an electronic device capable of wireless communication includes a housing of the device with a metal frame; a dielectric substrate arranged in the housing for supporting functional units for wireless communication; a dielectric cover arranged on top of the dielectric substrate; an antenna array including antenna elements arranged in the dielectric substrate, and configured to form traveling waves propagating in the dielectric substrate and the dielectric cover; and at least one spatial matching element arranged in space formed inside the dielectric substrate, spatially matched with the dielectric cover, and coupled with the at least one antenna element, wherein the spatial matching element may be configured to be spatially matched with the antenna array with the dielectric cover and to reduce reflections of traveling waves propagating from the antenna array to the dielectric cover.

In various embodiments, the antenna array may be formed by stripline antenna elements.

In various embodiments, the at least one of the spatial matching elements spatially matched with the dielectric cover may have a trapezoidal shape in the cross section.

In various embodiments, the at least one of the spatial matching elements spatially matched with the dielectric cover may include a first part, a second part, and a third part, the first part being configured to match the antenna array with the dielectric cover, ensuring the minimum standing-wave ratio by transition of radiation from the antenna array into the dielectric cover, the second part being a dielectric waveguide, and the third part being configured to provide minimum reflections from the borders of the third part is configured to provide minimum reflections from the borders of the spatial matching element spatially matched with the dielectric cover.

In various embodiments, the dielectric cover may have first dielectric permittivity $\varepsilon_1$ and the dielectric substrate may have second dielectric permittivity $\varepsilon_2$, and the first dielectric permittivity $\varepsilon_1$ may be higher than the second dielectric permittivity $\varepsilon_2$.

In various embodiments, the dielectric substrate may be a printed circuit board including functional units for performing communication, and the antenna array may be formed in the printed circuit board.

In various embodiments, the at least one of the spatial matching elements spatially matched with the dielectric cover may be formed in the printed circuit board.

In various embodiments, the at least one of the spatial matching elements spatially matched with the dielectric cover may be formed in a multi-layered printed circuit board, and the spatial matching element may be provided by interlayer metallized holes formed in an internal layer of the printed circuit board.

In various embodiments, the third part of the spatial matching element may have parameters defined by the height of the metal frame.

An electronic device having an antenna unit in accordance with various embodiments of the present disclosure may form antenna radiation directivity and increase the scanning range.

An electronic device having an antenna unit in accordance with other various embodiments of the present disclosure may improve the efficiency of a millimeter-range antenna and reduce signal loss.

An electronic device having an antenna unit in accordance with other various embodiments of the present disclosure may provide convenience for use of the electronic device through a metal frame forming the housing and improve communication performance.

Several embodiments have thus been described, but it will be understood that various modifications can be made without departing the scope of the present disclosure. Thus, it will be apparent to those ordinary skilled in the art that the present disclosure is not limited to the embodiments described, but can encompass not only the appended claims but the equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An antenna unit comprising:

a dielectric substrate;

a dielectric cover on, and in contact with, the dielectric substrate;

an antenna array including antenna elements arranged in the dielectric substrate, and configured to form traveling waves propagating in the dielectric substrate and the dielectric cover; and at least one spatial matching element arranged in space formed inside the dielectric substrate, spatially matched with the dielectric cover, and coupled with at least one of the antenna elements, wherein the spatial matching element is configured to be spatially matched with the antenna array with the dielectric cover and to reduce reflections of traveling waves propagating from the antenna array to the dielectric cover.

2. The antenna unit of claim 1, further comprising: a metal frame formed to enable wireless communication and allow wavelengths propagated from the dielectric cover to be matched with radiation space.

3. The antenna unit of claim 1, wherein the antenna array is formed by stripline antenna elements.

4. The antenna unit of claim 1, wherein the at least one spatial matching element spatially matched with the dielectric cover has a trapezoidal shape in a cross section.

5. The antenna unit of claim 1, wherein:

the at least one spatial matching element spatially matched with the dielectric cover comprises a first part, a second part, and a third part, the first part is configured to match the antenna array with the dielectric cover, to provide a minimum standing-wave ratio by transition of radiation from the antenna array into the dielectric cover, the second part is a dielectric waveguide, and the third part is configured to provide minimum reflections from borders of the third part is configured to provide minimum reflections from borders of the at least one spatial matching element spatially matched with the dielectric cover.

6. The antenna unit of claim 1, wherein:

the dielectric cover is configured to have a first dielectric permittivity $\varepsilon_1$ and the dielectric substrate is configured to have a second dielectric permittivity $\varepsilon_2$, and the first dielectric permittivity $\varepsilon_1$ is higher than the second dielectric permittivity $\varepsilon_2$.

7. An electronic device capable of wireless communication, the electronic device comprising:

a housing of the device with a metal frame;

a dielectric substrate arranged in the housing for supporting functional units for wireless communication;

a dielectric cover arranged in contact with a top surface of the dielectric substrate;

an antenna array including antenna elements arranged in the dielectric substrate, and configured to form traveling waves propagating in the dielectric substrate and the dielectric cover; and at least one spatial matching element arranged in space formed inside the dielectric substrate, spatially matched with the dielectric cover, and coupled with at least one of the antenna elements, wherein the spatial matching element is configured to be spatially matched with the antenna array with the dielectric cover and to reduce reflections of traveling waves propagating from the antenna array to the dielectric cover.

8. The electronic device of claim 7, wherein the antenna array is formed by stripline antenna elements.

9. The electronic device of claim 7, wherein the at least one spatial matching element spatially matched with the dielectric cover has a trapezoidal shape in a cross section.

10. The electronic device of claim 7, wherein:

the at least one spatial matching element spatially matched with the dielectric cover comprises a first part, a second part, and a third part, the first part is configured to match the antenna array with the dielectric cover, ensuring the minimum standing-wave ratio by transition of radiation from the antenna array into the dielectric cover, the second part is a dielectric waveguide, and the third part is configured to provide minimum reflections from borders of the third part is configured to provide minimum reflections from borders of the at least one spatial matching element spatially matched with the dielectric cover.

11. The electronic device of claim 7, wherein:

the dielectric cover is configured to have a first dielectric permittivity $\varepsilon_1$ and the dielectric substrate is configured to have a second dielectric permittivity $\varepsilon_2$, and the first dielectric permittivity $\varepsilon_1$ is higher than the second dielectric permittivity $\varepsilon_2$.

12. The electronic device of claim 7, wherein:

the dielectric substrate comprises a printed circuit board including functional units for performing communication, and the antenna array is formed in the printed circuit board.

13. The electronic device of claim 12, wherein the at least one of the spatial matching elements spatially matched with the dielectric cover is formed in the printed circuit board.

14. The electronic device of claim 12, wherein the at least one of the spatial matching elements spatially matched with the dielectric cover is formed in a multi-layered printed circuit board, and the spatial matching element is provided by interlayer metallized holes formed in an internal layer of the printed circuit board.

15. The electronic device of claim 10, wherein the third part of the spatial matching element has parameters defined by a height of the metal frame.

* * * * *